US008240487B2

(12) United States Patent
Noble

(10) Patent No.: US 8,240,487 B2
(45) Date of Patent: Aug. 14, 2012

(54) MERCHANDIZING HANGER

(75) Inventor: Matthew D. Noble, Los Angeles, CA (US)

(73) Assignee: Custom LeatherCraft Manuf. Co., Inc., Southgate, CA (US)

( * ) Notice: Subject to any disclaimer, the term of this patent is extended or adjusted under 35 U.S.C. 154(b) by 420 days.

(21) Appl. No.: 12/459,072

(22) Filed: Jun. 26, 2009

(65) Prior Publication Data

US 2010/0326935 A1 Dec. 30, 2010

(51) Int. Cl.
*A47G 29/00* (2006.01)

(52) U.S. Cl. ..... 211/85.3

(58) Field of Classification Search ..... 211/85.3, 211/85.4, 113, 59.1, 59.2, 54.1; 2/24, 22; 206/296; 223/85, 86
See application file for complete search history.

(56) References Cited

U.S. PATENT DOCUMENTS

| | | | | | |
|---|---|---|---|---|---|
| 2,279,760 | A * | 4/1942 | Pease | 211/113 |
| 3,790,045 | A * | 2/1974 | Rigel et al. | 223/87 |
| 4,718,546 | A * | 1/1988 | Kolton et al. | 206/296 |
| 4,759,440 | A * | 7/1988 | Kolton et al. | 206/296 |
| 4,768,649 | A * | 9/1988 | Kolton et al. | 206/296 |
| 4,940,146 | A * | 7/1990 | Kolton et al. | 211/85.3 |
| 4,978,043 | A * | 12/1990 | Uke | 223/88 |
| 5,040,686 | A * | 8/1991 | Morrow | 211/85.3 |
| 5,931,314 | A * | 8/1999 | Jackstat et al. | 211/34 |
| 6,176,378 | B1 * | 1/2001 | Neubauer et al. | 211/113 |
| 6,481,182 | B1 * | 11/2002 | Fuller | 53/399 |
| D588,310 | S * | 3/2009 | Dancyger et al. | D29/121.1 |
| 2004/0099618 | A1 * | 5/2004 | Ford et al. | 211/59.1 |
| 2007/0150993 | A1 * | 7/2007 | Oh et al. | 2/24 |
| 2008/0296242 | A1 * | 12/2008 | Worden et al. | 211/113 |
| 2009/0119817 | A1 * | 5/2009 | Sonner | 2/2.5 |
| 2010/0326935 | A1 * | 12/2010 | Noble | 211/85.3 |

* cited by examiner

*Primary Examiner* — Sarah Purol

(57) ABSTRACT

The invention provides a merchandise hanger including a first hanging portion including a first arm, a second hanging portion including a second arm, and a center portion connected to the first hanging portion and the second hanging portion. The first arm, the second arm and the center portion are configured to connect to merchandise.

14 Claims, 13 Drawing Sheets

MERCHANDIZING HANGER

BACKGROUND

1. Field

The embodiments relate to hangers, and in particular to merchandizing hangers.

2. Description of the Related Art

Packaging of products is important for presenting merchandise, reducing the footprint necessary for displaying merchandise and for storage. Products are typically placed on shelves for display or hung on hooks attached to pegboards or a similar support base or wall.

Merchandise that is presented in pairs has additional challenges as the pair may become separated. Additionally, presentation of a pair of goods is important to the sale of the goods as well as reduction of storage footprint and ease of showcasing the products. Usually these pairs of items may be boxed or enclosed in packaging. This type of presentation and display of the merchandise, however, prevents potential buyers from being able to see all aspects of the product or actually touch the product without removing the product from the packaging.

SUMMARY

One embodiment of the invention includes a merchandise hanger including a first hanging portion including a first arm, a second hanging portion including a second arm, and a center portion connected to the first hanging portion and the second hanging portion. The first arm, the second arm and the center portion are configured to connect to merchandise.

Another embodiment of the invention includes a system including a merchandise hanger with a first holding portion, a second holding portion and a center holding portion. The first holding portion including a first arm and the second holding portion including a second arm. A display card is connected to the merchandise hanger. A first kneepad is connected to the first holding portion and a second kneepad is connected to the second holding portion. The first kneepad is connected to the first arm and the second kneepad is connected to the second arm.

Yet another embodiment of the invention provides a method. The method includes providing a merchandise hanger including a first holding portion, a second holding portion and a center connecting portion, providing pair of kneepads including a first kneepad and a second kneepad, attaching the first kneepad to the first holding portion and the center portion, and attaching the second kneepad to the second holding portion and the center portion.

Still another embodiment of the invention provides a kneepad display hanger including a first holding portion including a first arm, a second holding portion including a second arm, and a center portion connected to the first holding portion and the second holding portion. The first arm is configured to connect to a first kneepad, and the second arm is configured to couple to a second kneepad.

Other aspects and advantages of the present invention will become apparent from the following detailed description, which, when taken in conjunction with the drawings, illustrate by way of example the principles of the invention.

BRIEF DESCRIPTION OF THE DRAWINGS

The embodiments are illustrated by way of example, and not by way of limitation, in the Figures of the accompanying drawings and in which like reference numerals refer to similar elements and in which.

DETAILED DESCRIPTION

The following description is made for the purpose of illustrating the general principles of the invention and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

The description may disclose several preferred embodiments of merchandizing hanger devices, as well as operation and/or component parts thereof. While the following description will be described in terms of merchandizing hangers for clarity and to place the invention in context, it should be kept in mind that the teachings herein may have broad application to all types of systems, devices and applications.

One embodiment of the invention provides a merchandise hanger including a first hanging portion including a first arm, a second hanging portion including a second arm, and a center portion connected to the first hanging portion and the second hanging portion. The first arm, the second arm and the center portion are configured to connect to merchandise.

Figure 1:
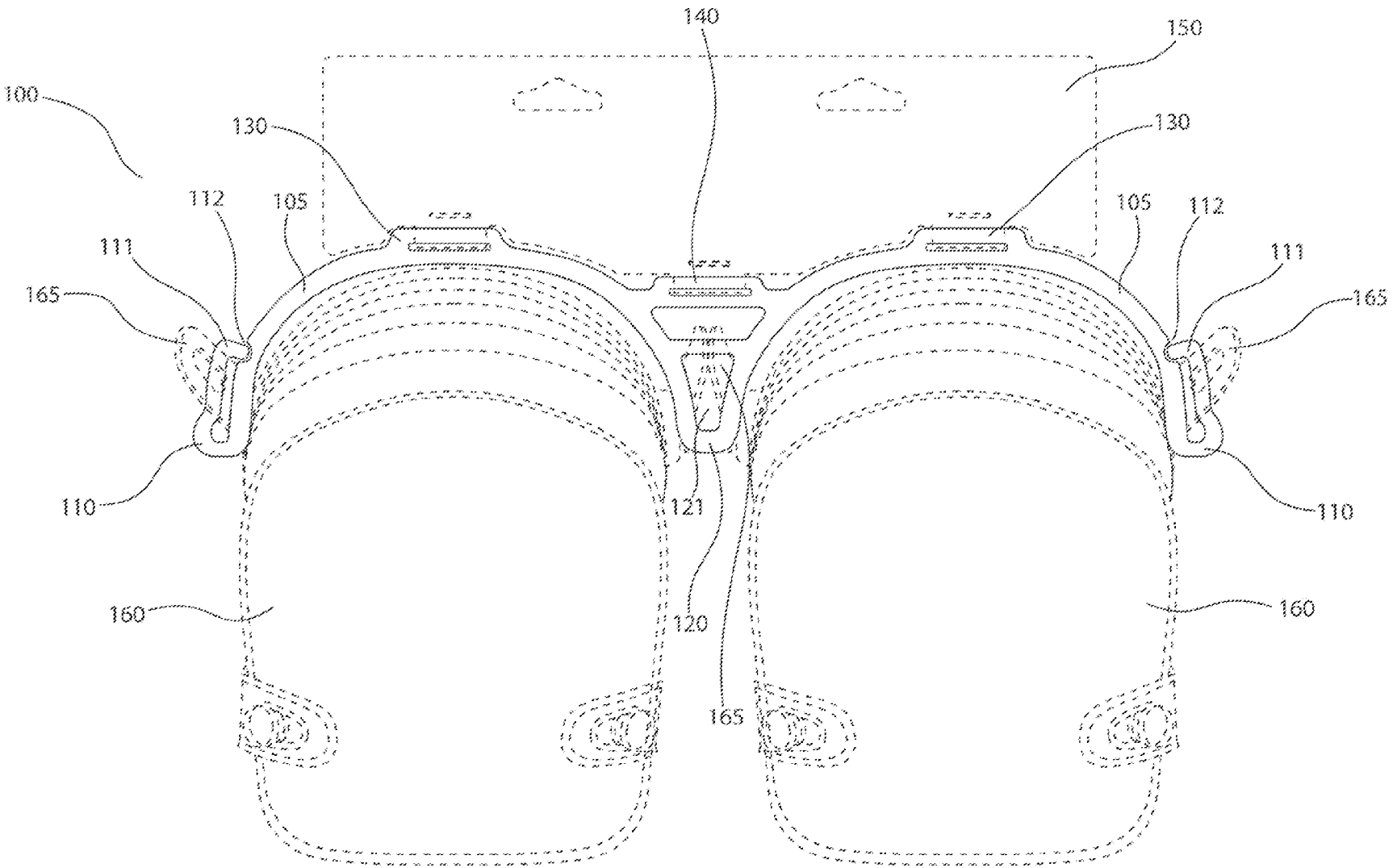
FIG. 1 illustrates a front view of a merchandising hanger according to one embodiment of the invention.

FIG. 1 illustrates a front view of a merchandising hanger 100 according to one embodiment of the invention. Merchandizing hanger 100 includes a first and second hanging/holding portions 105, a first and a second arm 110 and a center portion 120. In one embodiment of the invention the first hanging portion 105 and the second hanging portion 105 each have an opening/slit 130, and center portion 120 includes an opening/slit 140 that are configured to connect to a display and hanging card 150.

In one embodiment of the invention, the first arm 110 and the second arm 110 each are molded upward and include a tab 111 that is configured to fit within a slot 112. In one embodiment of the invention the first arm 110 and the second arm 110 are configured to hold a coupling portion 165 of respective kneepads 160 of a pair of kneepads. In one embodiment of the invention center portion 120 includes a window 121 that is configured to hold another section of the coupling portion 165 of respective kneepads 160 of a pair of kneepads. The fitting of the tab 111 within the slot 112 prevents the coupling portions 165 from sliding or slipping off of the arms 110. For ease of removal, the arms 110 can be pulled away from the hanging portions 105 to remove the tabs 111 from the slots 112.

By using the coupling portions 165 of kneepads 160 to attach a pair of kneepads to the merchandising hanger 100 it is not necessary to have additional material or attaching elements to connect the kneepads 160 to the merchandising hanger 100. Kneepads 160 are held in an aesthetic manner so that the complete kneepads 160 can be viewed front and back without any portions being hidden. Additionally, the kneepads 160 being held by the merchandising hanger 100 can be tried on without damaging to packaging.

In one embodiment of the invention the merchandising hanger 100 is formed via molding methods and is made out of recyclable material, such as polyethylene terephthalate (PET) plastic, polyvinyl chloride (PVC), etc.

In one embodiment of the invention the merchandising hanger 100 directly couples to the display card 150. In this embodiment of the invention the display card 150 has connecting portions that couple through the slits 130 and 140 of the merchandising hanger 100.

Figure 2:
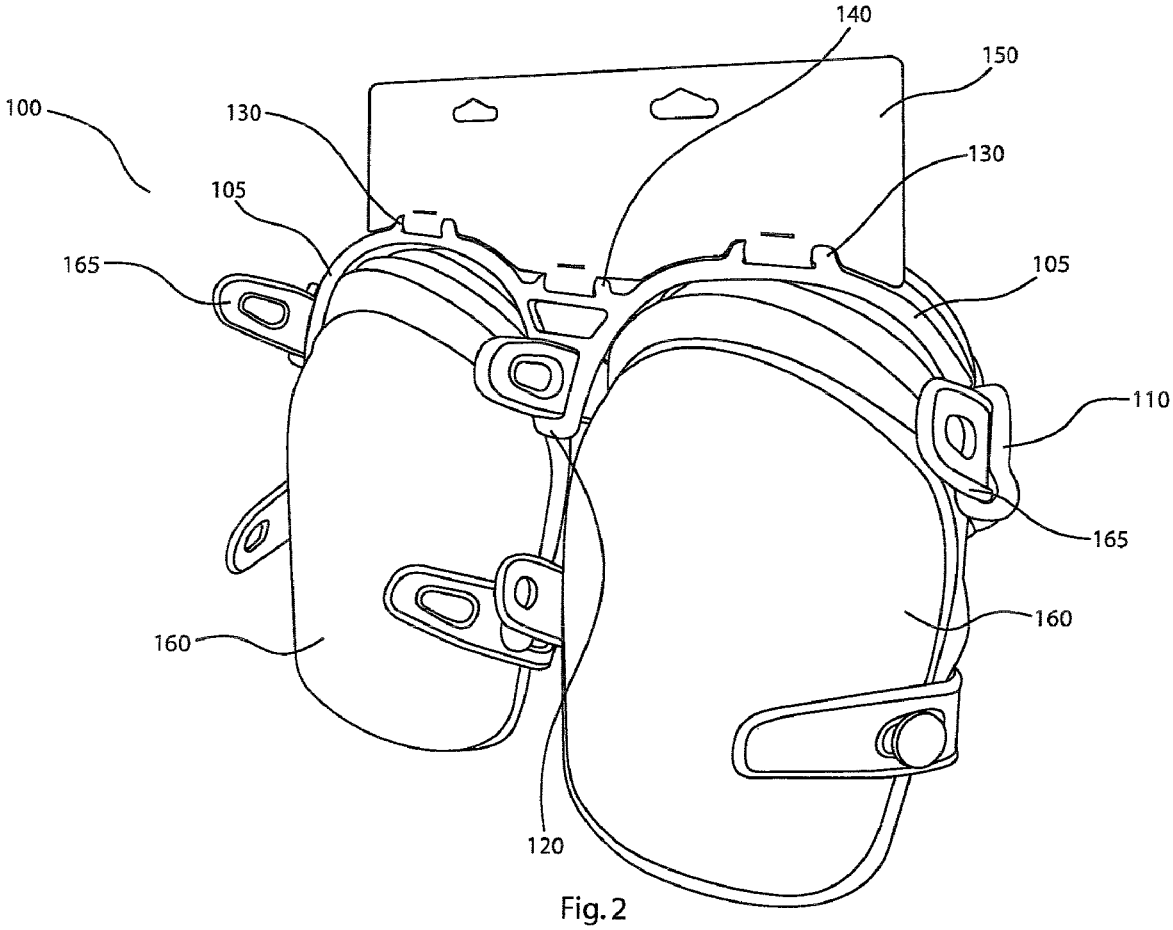
FIG. 2 illustrates a perspective view of the merchandising hanger illustrated in FIG. 1 including a pair of kneepads and a merchandise display card according to one embodiment of the invention.

FIG. 2 illustrates a perspective view of merchandising hanger 100 connected to kneepads 160 of a pair of kneepads and a display card 150. As illustrated, the merchandising hanger 100 has hanging portions 105 that are configured in a curved mariner to aesthetically display kneepads 160, which fit within the arch shaped hanging portions 105 of the merchandising hanger 100. The connecting portions 165 of the kneepads 160 being connected to the arms 110 and the center portion 120 hold the kneepads 160 in a stable configuration for ship packaging (e.g., in boxes) and display by hanging from display card 150.

Figure 3:
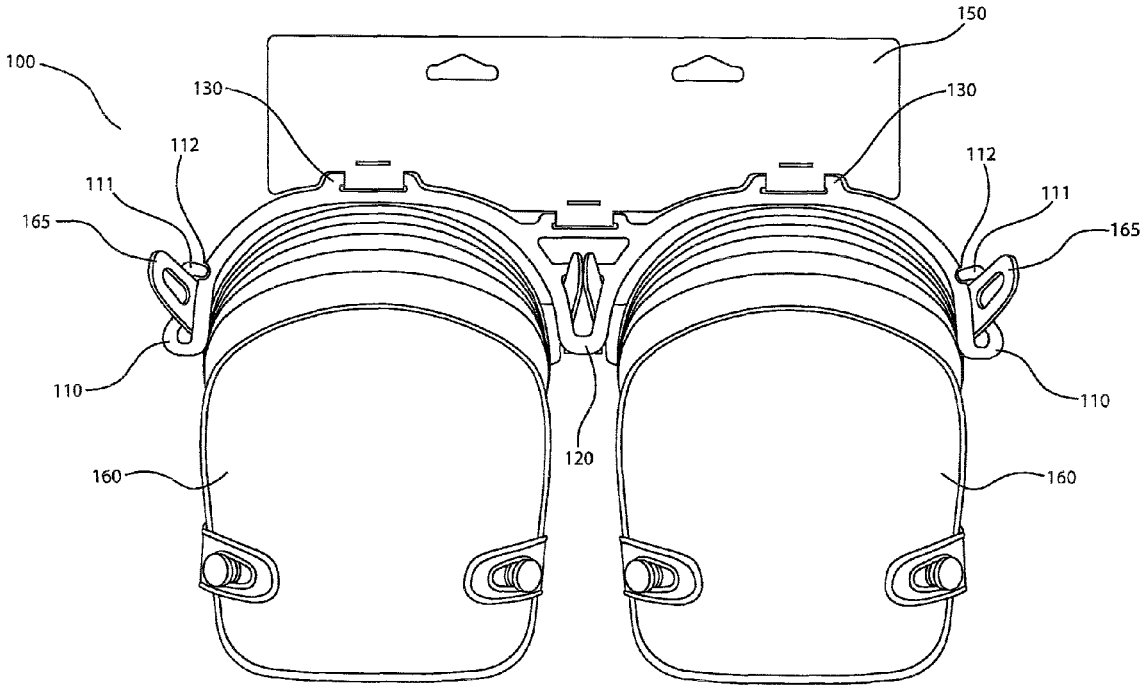
FIG. 3 illustrates a front view of the merchandising hanger illustrated in FIG. 1 including a pair of kneepads and a merchandise display card according to one embodiment of the invention.
Figure 4:
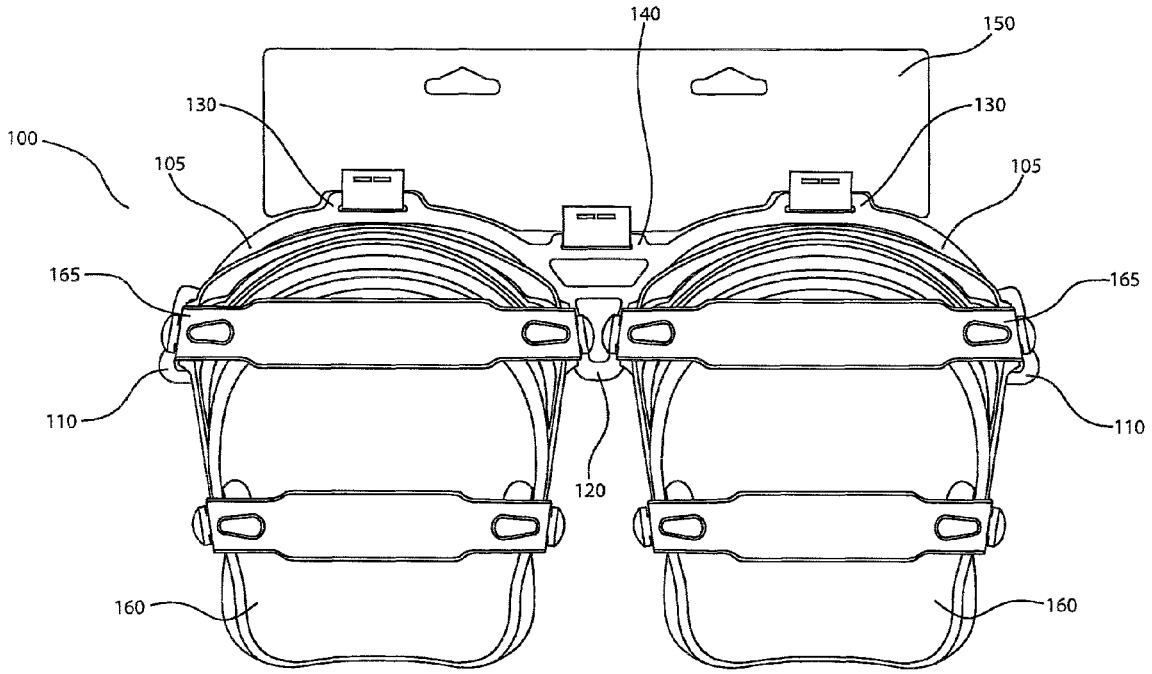
FIG. 4 illustrates a rear view of the merchandising hanger illustrated in FIG. 1 including a pair of kneepads and a merchandise display card according to one embodiment of the invention.

FIG. 3 illustrates a front view of merchandising hanger 100 connected to kneepads 160 of a pair of kneepads and a display card 150. FIG. 4 illustrates a rear view of merchandising hanger 100 connected to kneepads 160 of a pair of kneepads and a display card 150. As illustrated the merchandising hanger 100 is an efficient and low cost means for displaying kneepads 160 than alternative box packaging and loose packaging of pairs of kneepads in boxes, which take up shelf space and do not allow a full view display of the products.

Figure 5:
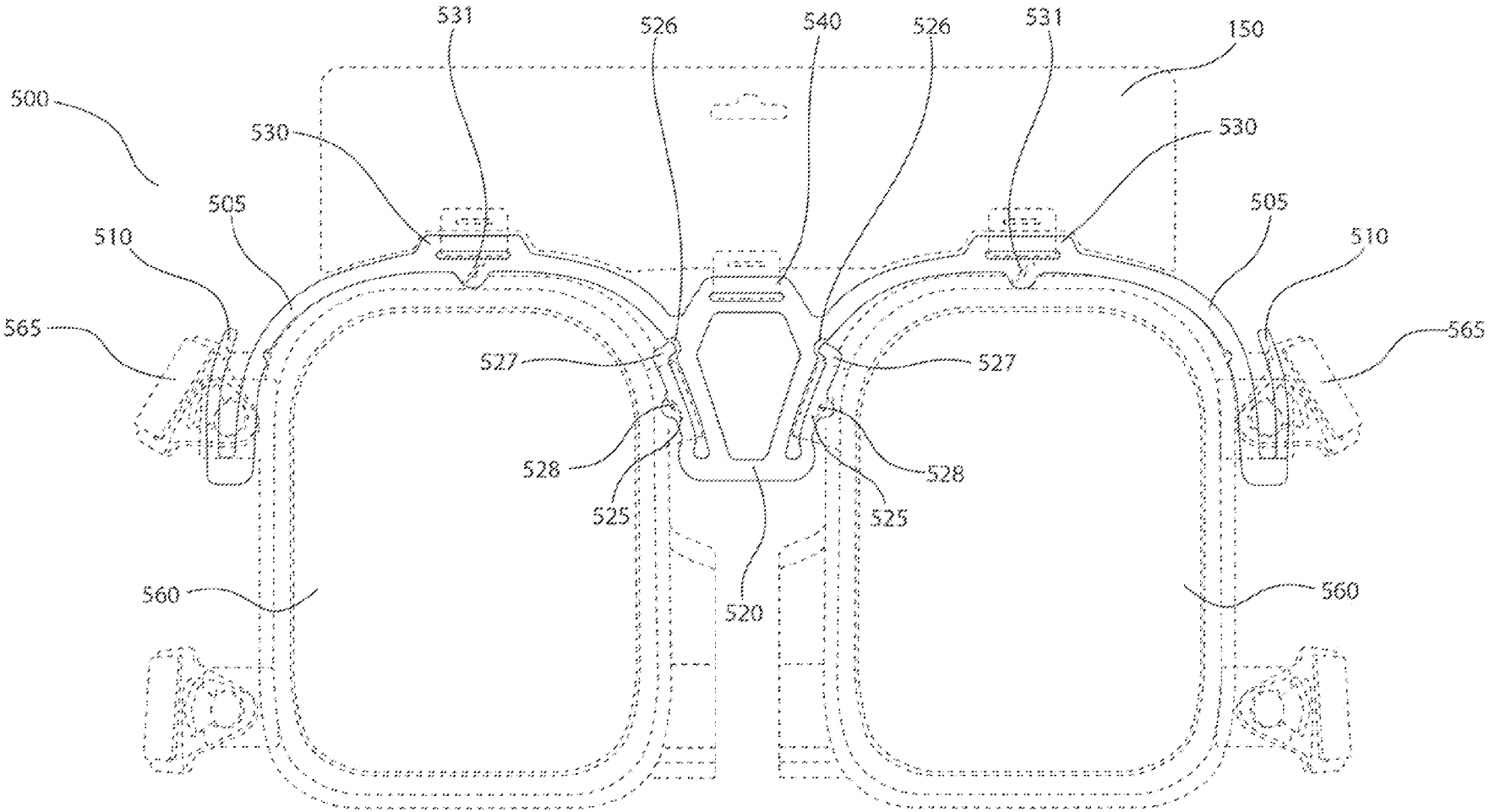
FIG. 5 illustrates a front view of a merchandising hanger according to another embodiment of the invention.

FIG. 5 illustrates a front view of a merchandising hanger 500 according to another embodiment of the invention. In one embodiment the invention merchandizing hanger 500 includes a first and second hanging/holding portions 505, a first and a second arm 510 and a center portion 520. In one embodiment of the invention the first hanging portion 505 and the second hanging portion 505 each have an opening/slit 530, and center portion 520 includes an opening/slit 540 that are configured to connect to a display and hanging card 150.

In one embodiment of the invention the hanging portions 505 include a through hole 531 configured to hold a merchandise tag element connected to kneepads 560. In one embodiment of the invention the through holes 531 provide a means for coupling kneepads 560 to the merchandising hanger 500 to help prevent easy removal from the merchandising hanger 500 by unclasping of kneepad coupling portions 565.

In one embodiment of the invention, the first arm 510 and the second arm 510 each are molded upward and create an open channel configured to easily hold kneepad coupling portions 565 by sliding or placing the coupling portions 565 in the arm 510 channel.

In one embodiment of the invention center portion 520 includes arms 525 that are configured to hold another section of the coupling portion 565 of respective kneepads 560 of a pair of kneepads. In one embodiment of the invention the arms 525 include a tab 527 that is configured to fit within a slot 526. The fitting of the tab 527 within the slot 526 prevents the coupling portions 565 from sliding or slipping off of the arms 525. For ease of removal of the kneepads 560 coupling portions 565 from the arms 525, the arms 525 can be pulled away from the center portion 520 to remove the tabs 527 from the slots 526.

In one embodiment of the invention the arms 525 include through holes 528 that are configured to hold a merchandising tag element that can also be coupled to the kneepads 560. The merchandising tag elements coupled through the through holes 528 assist to prevent easy removal of the kneepads 560 from the merchandising hanger 500.

By using the coupling portions 565 of kneepads 560 to attach a pair of kneepads to the merchandising hanger 500 it is not necessary to have additional material or attaching elements to connect the kneepads 560 to the merchandising hanger 500. Kneepads 560 are held in an aesthetic manner so that the complete kneepads 560 can be viewed front and back without any portions being hidden. Additionally, the kneepads 560 being held by the merchandising hanger 500 can be tried on without damaging to packaging.

In one embodiment of the invention the merchandising hanger 500 is formed via molding methods and is made out of recyclable material, such as polyethylene terephthalate (PET) plastic, polyvinyl chloride (PVC), etc.

In one embodiment of the invention the merchandising hanger 500 directly couples to the display card 150. In this embodiment of the invention the display card 150 has connecting portions that couple through the slits 530 and 540 of the merchandising hanger 500.

Figure 6:
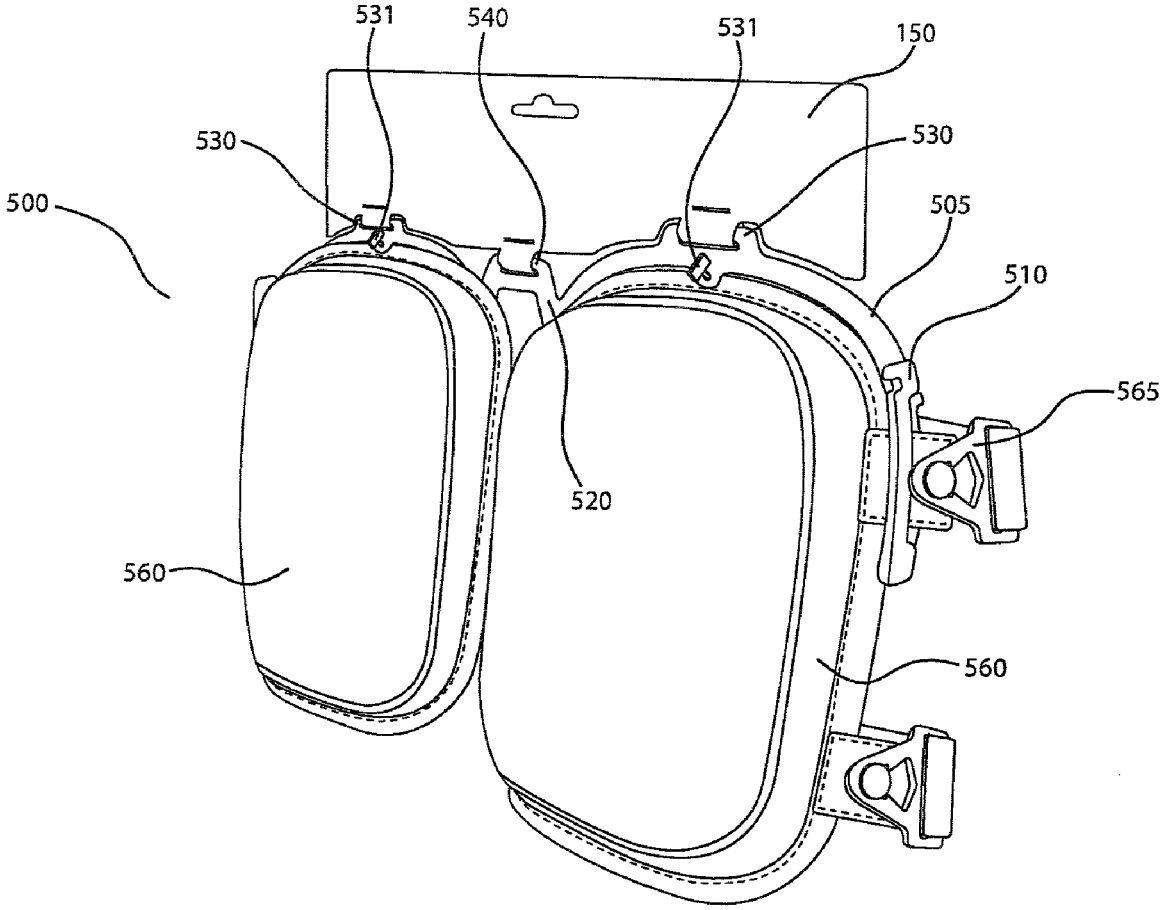
FIG. 6 illustrates a perspective view of the merchandising hanger illustrated in FIG. 5 including a pair of kneepads and a merchandise display card according to one embodiment of the invention.

FIG. 6 illustrates a perspective view of merchandising hanger 500 connected to kneepads 560 of a pair of kneepads and a display card 150. As illustrated, the merchandising hanger 500 has hanging portions 505 that are configured in a curved manner to aesthetically display kneepads 560, which fit within the arch shaped hanging portions 505 of the merchandising hanger 500. The connecting portions 565 of the kneepads 560 being connected to the arms 510 and the center portion 520 hold the kneepads 560 in a stable configuration for ship packaging (e.g., in boxes) and display by hanging from display card 150.

Figure 7:
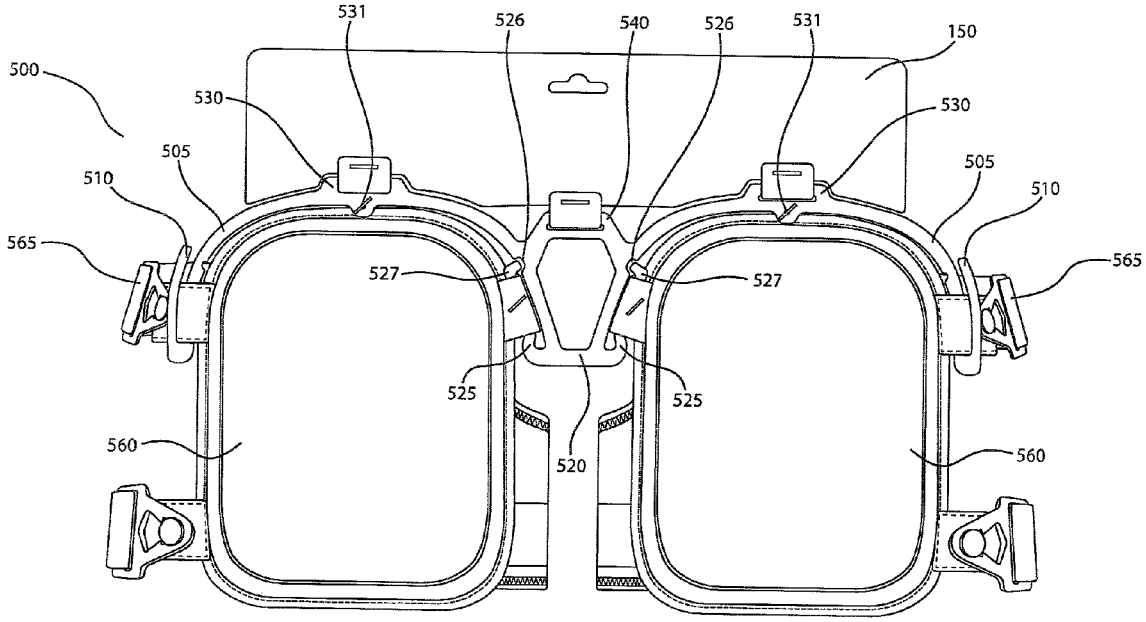
FIG. 7 illustrates a front view of the merchandising hanger illustrated in FIG. 5 including a pair of kneepads and a merchandise display card according to one embodiment of the invention.
Figure 8:
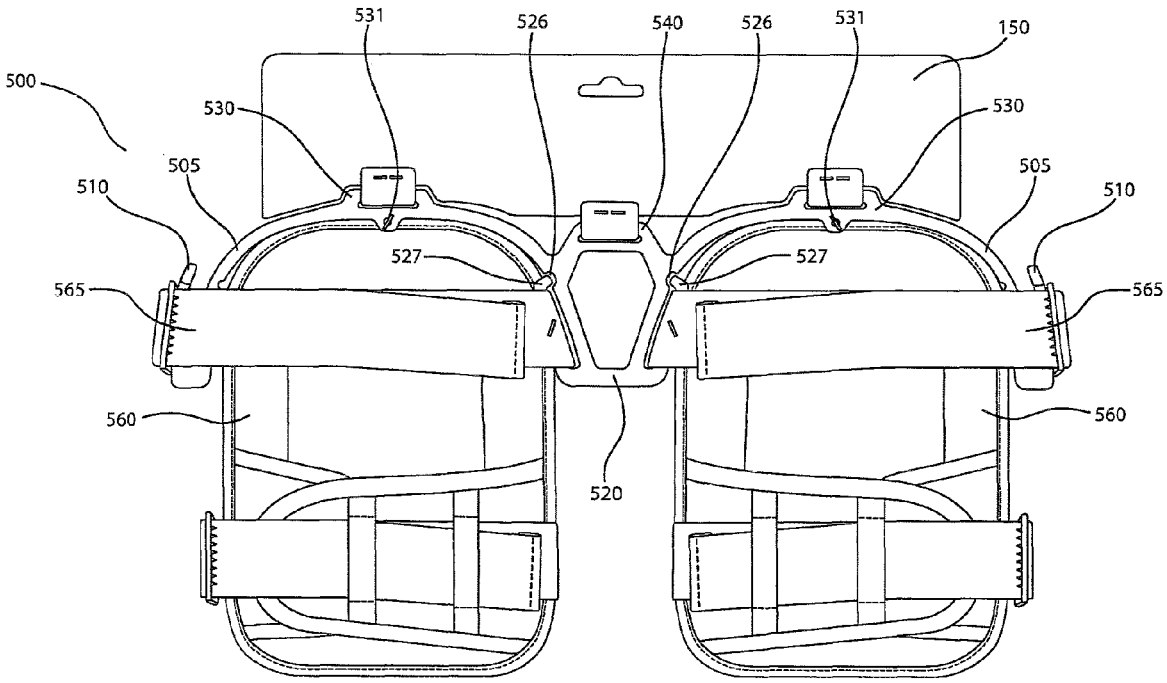
FIG. 8 illustrates a rear view of the merchandising hanger illustrated in FIG. 5 including a pair of kneepads and a merchandise display card according to one embodiment of the invention.

FIG. 7 illustrates a front view of merchandising hanger 500 connected to kneepads 560 of a pair of kneepads and a display card 150. FIG. 8 illustrates a rear view of merchandising hanger 500 connected to kneepads 560 of a pair of kneepads and a display card 150. As illustrated the merchandising hanger 500 is an efficient and low cost means for displaying kneepads 560 than alternative box packaging and loose packaging of pairs of kneepads in boxes, which take up shelf space and do not allow a full view display of the products. In this embodiment of the invention the merchandising hanger 500 is configured to hold a pair of kneepads 560 that have a different type of connecting portions 565 than the embodiment illustrated in FIGS. 1-4.

Figure 9:
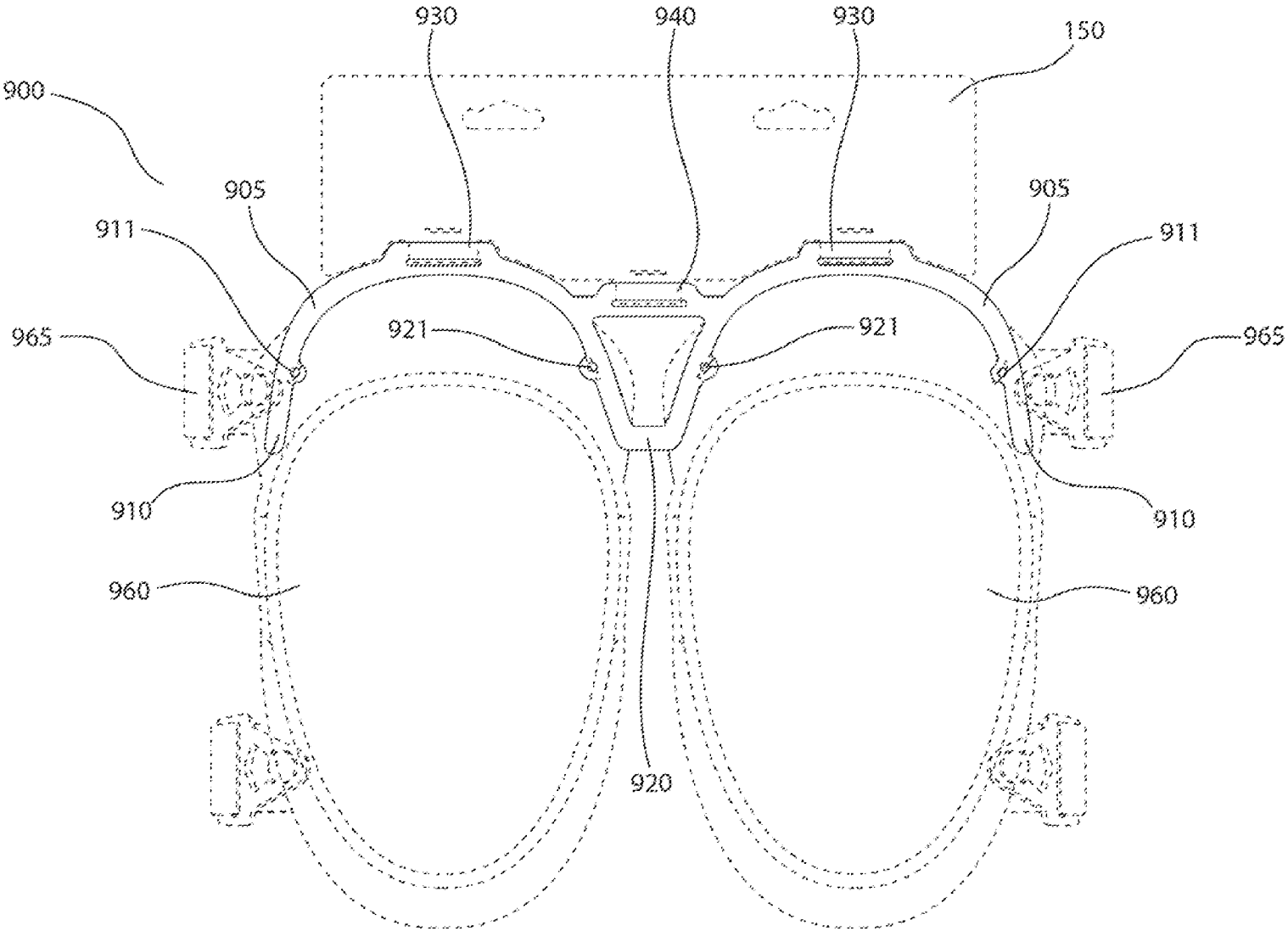
FIG. 9 illustrates a front view of a merchandising hanger according to still another embodiment of the invention.

FIG. 9 illustrates a front view of a merchandising hanger 900 according to another embodiment of the invention. In one embodiment the invention merchandizing hanger 900 includes a first and second hanging/holding portions 905, a first and a second arm 910 and a center portion 920. In one embodiment of the invention the first hanging portion 905 and the second hanging portion 905 each have an opening/slit 930, and center portion 920 includes an opening/slit 940 that are configured to connect to a display and hanging card 150.

In one embodiment of the invention the arms 910 each include a through hole 911 configured to hold a merchandise tag element connected to kneepads 960. In one embodiment of the invention the through holes 911 provide a means for coupling kneepads 960 to the merchandising hanger 900 to help prevent easy removal from the merchandising hanger 900.

In one embodiment of the invention center portion 920 includes through holes 921 that are configured to hold a merchandising tag element that couple to the kneepads 960 to hold the kneepads 960 to the merchandising hanger 900. The merchandising tag elements coupled through the through holes 921 assist to prevent easy removal of the kneepads 960 from the merchandising hanger 900.

By using the merchandising tag elements to attach kneepads 960 of a pair of kneepads to the merchandising hanger 900 it is not necessary to have additional material to connect the kneepads 960 to the merchandising hanger 900. Kneepads 960 are held in an aesthetic manner so that the complete kneepads 960 can be viewed front and back without any portions being hidden. Additionally, the kneepads 960 being held by the merchandising hanger 900 can be tried on without damaging to packaging.

In one embodiment of the invention the merchandising hanger 900 is formed via molding methods and is made out of recyclable material, such as polyethylene terephthalate (PET) plastic, polyvinyl chloride (PVC), etc.

In one embodiment of the invention the merchandising hanger 900 directly couples to the display card 150. In this embodiment of the invention the display card 150 has connecting portions that couple through the slits 930 and 940 of the merchandising hanger 900.

Figure 10:
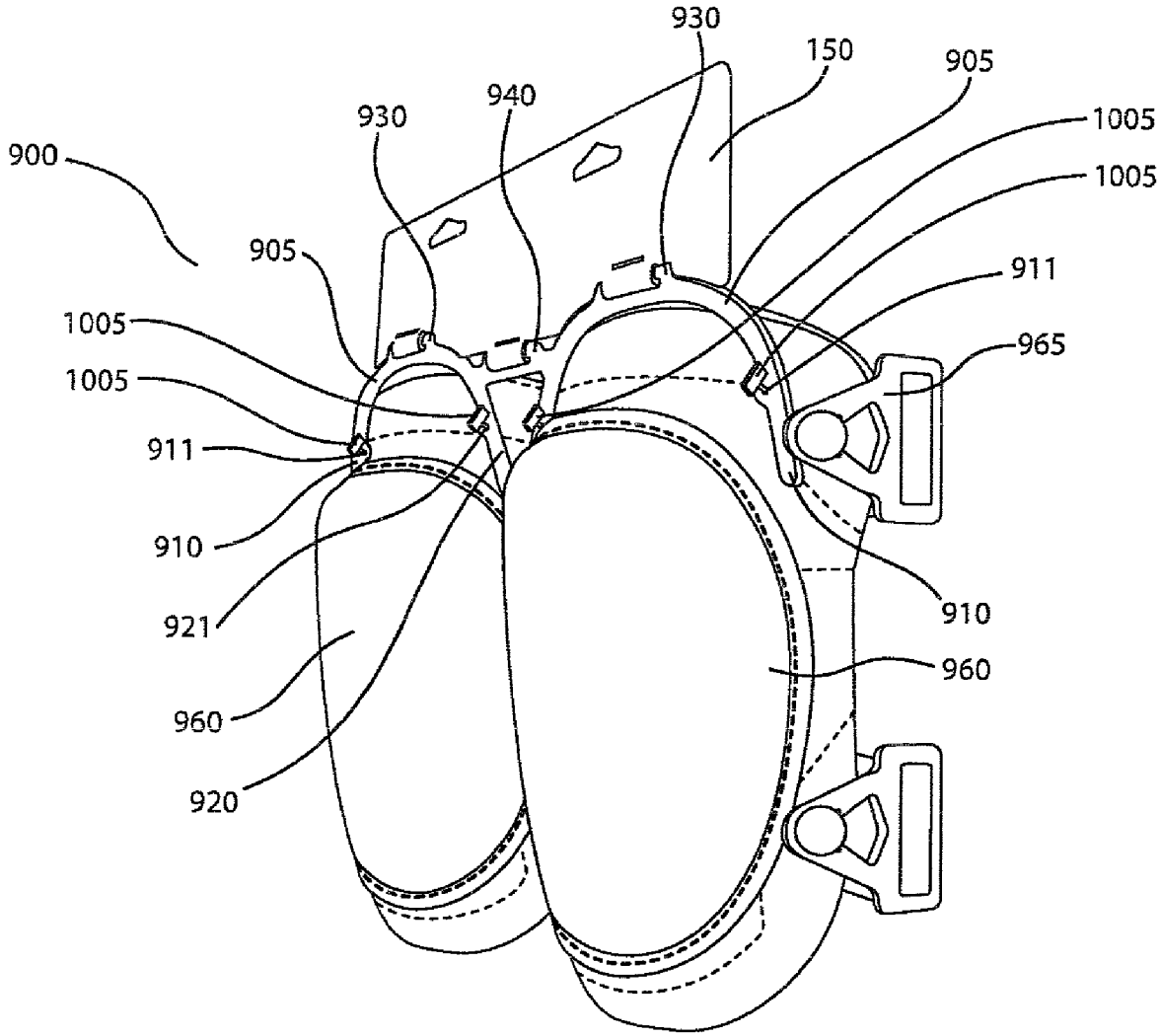
FIG. 10 illustrates a perspective view of the merchandising hanger illustrated in FIG. 9 including a pair of kneepads and a merchandise display card according to one embodiment of the invention.

FIG. 10 illustrates a perspective view of merchandising hanger 900 connected to kneepads 960 of a pair of kneepads and a display card 150. As illustrated, the merchandising hanger 900 has hanging portions 905 that are configured in a curved manner to aesthetically display kneepads 960, which fit within the arch shaped hanging portions 905 of the merchandising hanger 900. The tag elements 1005 coupled to the kneepads 960 through the through holes 911 and 921 hold the kneepads 960 in a stable configuration for ship packaging (e.g., in boxes) and display by hanging from display card 150.

Figure 11:
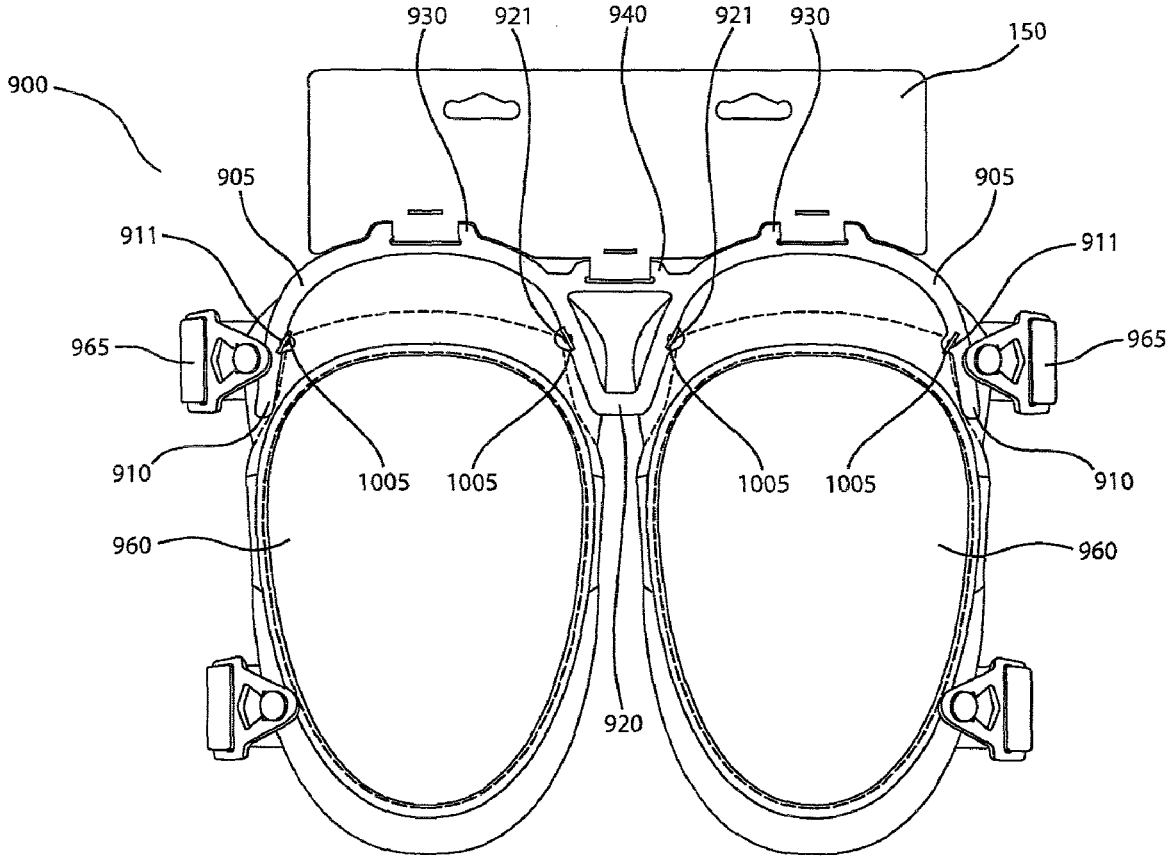
FIG. 11 illustrates a front view of the merchandising hanger illustrated in FIG. 9 including a pair of kneepads and a merchandise display card according to one embodiment of the invention.
Figure 12:
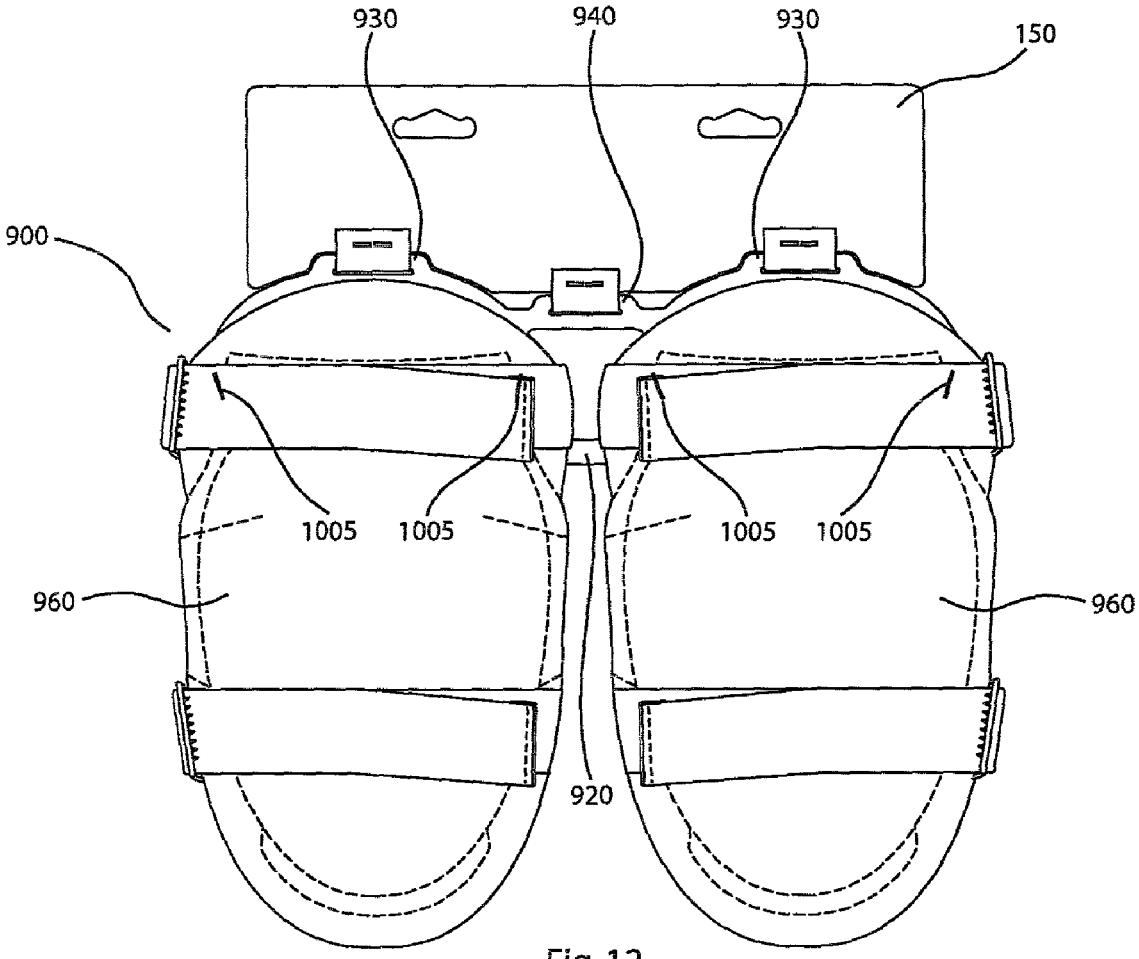
FIG. 12 illustrates a rear view of the merchandising hanger illustrated in FIG. 9 including a pair of kneepads and a merchandise display card according to one embodiment of the invention.

FIG. 11 illustrates a front view of merchandising hanger 900 connected to kneepads 960 of a pair of kneepads and a display card 150. FIG. 12 illustrates a rear view of merchandising hanger 900 connected to kneepads 960 of a pair of kneepads and a display card 150. As illustrated the merchandising hanger 900 is an efficient and low cost means for displaying kneepads 960 than alternative box packaging and loose packaging of pairs of kneepads in boxes, which take up shelf space and do not allow a full view display of the products. In this embodiment of the invention the merchandising hanger 900 is configured to hold a pair of kneepads 960 that have a different type of connecting portions 965 than the embodiments illustrated in FIGS. 1-8. As illustrated the connecting portions 965 are pierced by merchandising tags 1005, which are disposed through the through holes 911 and 921 (see FIGS. 10-11).

Figure 13:
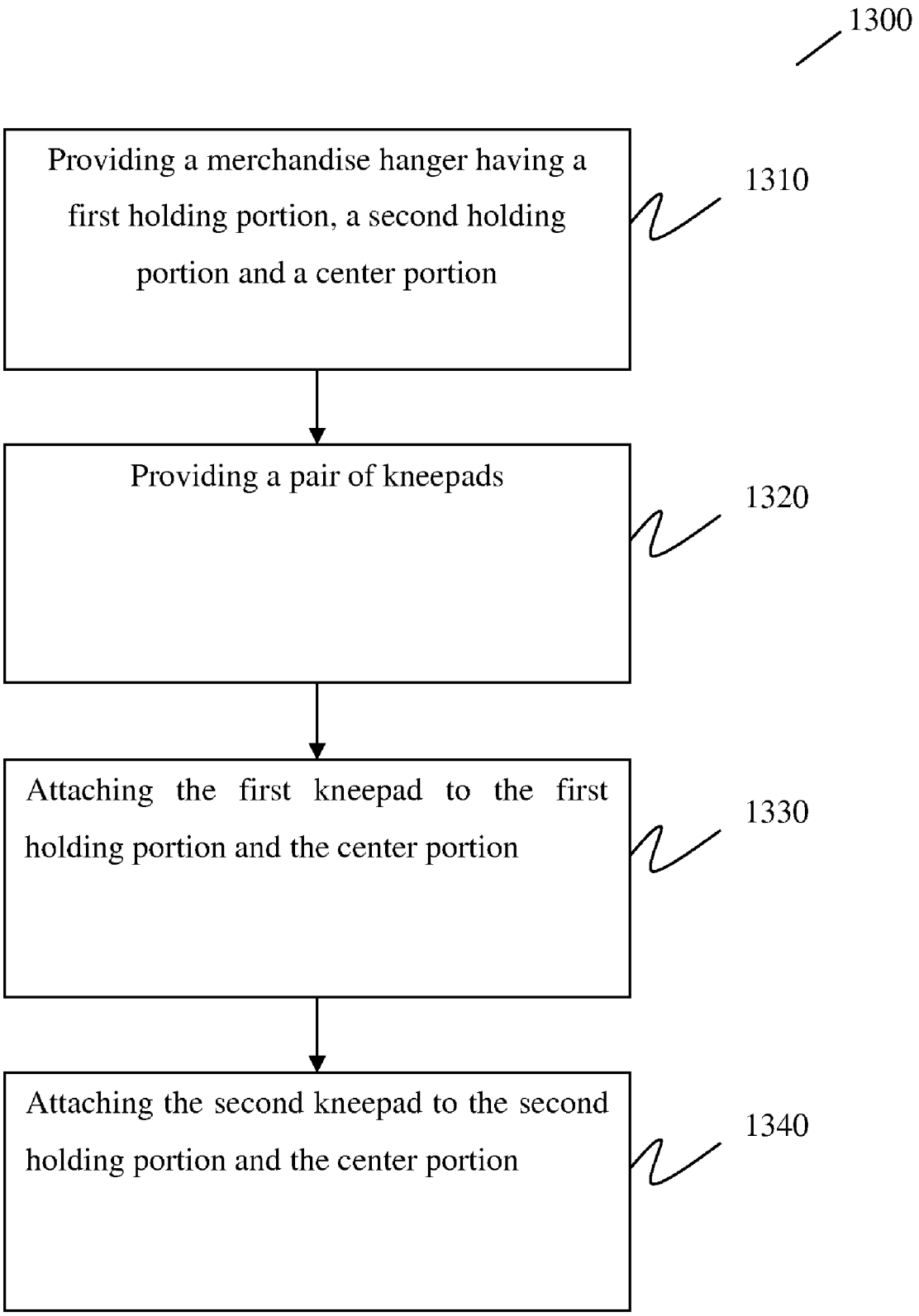
FIG. 13 illustrates a block diagram of a process for attaching a pair of kneepads and a display card to a merchandising hanger.

FIG. 13 illustrates a block diagram of a process 1300 for attaching a pair of kneepads and a display card (e.g., display card 150) to a merchandising hanger (e.g., merchandising hangers 100, 500 or 900) according to one embodiment of the invention. In block 1310 a merchandise hanger (e.g., merchandise hanger 100, 500 or 900) is provided including a first holding portion, a second holding portion and a center connecting portion. In block 1320 a pair of kneepads are provided (e.g., kneepads 160, 560 or 960) including a first kneepad and a second kneepad.

Process 1300 continues with block 1330 where the first kneepad is attached to the first holding portion. In block 1340 the second kneepad is attached to the second holding portion and the center portion. In one embodiment of the invention attaching the first kneepad further comprises attaching a strap of the first kneepad to an arm of the first holding portion of the merchandising hanger and attaching the second kneepad further comprises attaching a strap of the second kneepad to an arm of the second holding portion.

In one embodiment of the invention process 1300 further includes attaching a strap of the first kneepad to an arm of the center connecting portion and attaching the strap of the second kneepad to another arm of the center connecting portion. In one embodiment of the invention process 1300 further includes attaching a merchandise card to the merchandise hanger, where the merchandise card is configured to hang the merchandise hanger and the pair of kneepads to a display hanger. In some embodiments of the invention the pair of kneepads is directly coupled to the merchandise hanger.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A system comprising:

a merchandise hanger including a first holding portion, a second holding portion and a center holding portion, the first holding portion including a first arm and the second holding portion including a second arm;

a display card coupled to the merchandise hanger; and a first kneepad coupled to the first holding portion and a second kneepad coupled to the second holding portion, wherein the first kneepad is coupled to the first arm and the second kneepad is coupled to the second arm.

2. The system of claim 1, wherein the first holding portion includes a first slot and the second holding portion includes a second slot, and the first arm includes a first tab configured to fit within the first slot, and the second arm includes a second tab configured to fit within the second slot.

3. The system of claim 1, wherein the center portion further including a third arm and a fourth arm.

4. The system of claim 3, wherein the center portion includes a third slot and a fourth slot, the third arm includes a third tab and the fourth arm includes a fourth tab, and the third tab is configured to fit within the third slot and the fourth tab is configured to fit within the fourth slot.

5. The system of claim 1, wherein the center portion including at least one through-hole.

6. The system of claim 5, wherein the first hanging portion and the second hanging portion each including a through-hole.

7. The system of claim 5, wherein the at least one through-hole is configured to couple to a coupling member.

8. The system of claim 5, wherein the center portion is configured to couple to a strapping means of the first kneepad and the second kneepad.

9. A method comprising:

providing a merchandise hanger including a first holding portion, a second holding portion and a center connecting portion;

providing a pair of kneepads including a first kneepad and a second kneepad;

attaching the first kneepad to the first holding portion and the center portion; and attaching the second kneepad to the second holding portion and the center portion.

10. The method of claim 9, wherein attaching the first kneepad further comprises attaching a strap of the first kneepad to an arm of the first holding portion.

11. The method of claim 10, wherein the attaching the second kneepad further comprises attaching a strap of the second kneepad to an arm of the second holding portion.

12. The method of claim 11, further comprising attaching the strap of the first kneepad to an arm of the center connecting portion and attaching the strap of the second kneepad to another arm of the center connecting portion.

13. The method of claim 9, further comprising attaching a merchandise card to the merchandise hanger, wherein the merchandise card is configured to hang the merchandise hanger and the pair of kneepads to a display hanger.

14. The method of claim 13, wherein the pair of kneepads are directly coupled to the merchandise hanger.

* * * * *